US010441013B1

(12) United States Patent
Emery et al.

(10) Patent No.: US 10,441,013 B1
(45) **Date of Patent: *Oct. 15, 2019**

(54) FLAME RESISTANT FABRIC HAVING INTERMINGLES FLAME RESISTANT YARNS

(71) Applicant: Milliken & Company, Spartanburg, SC (US)

(72) Inventors: Nathan B. Emery, Spartanburg, SC (US); Patrick K. Prince, Moore, SC (US)

(73) Assignee: Milliken & Company, Spartanburg, SC (US)

( * ) Notice: Subject to any disclaimer, the term of this patent is extended or adjusted under 35 U.S.C. 154(b) by 296 days.

This patent is subject to a terminal disclaimer.

(21) Appl. No.: 15/624,176

(22) Filed: Jun. 15, 2017

Related U.S. Application Data

(63) Continuation of application No. 13/604,180, filed on Sep. 5, 2012, now Pat. No. 9,706,804, which is a continuation of application No. 13/190,550, filed on Jul. 26, 2011, now abandoned.

(51) Int. Cl.

| | |
|---|---|
| ***A41D 31/08*** | (2019.01) |
| ***D03D 15/12*** | (2006.01) |
| ***D02G 3/02*** | (2006.01) |
| ***D02G 3/28*** | (2006.01) |

(52) U.S. Cl.
CPC ..... *A41D 31/08* (2019.02); *D03D 15/12* (2013.01)

(58) Field of Classification Search
CPC ..... A41D 31/08
USPC ..... 428/920, 921
See application file for complete search history.

(56) References Cited

U.S. PATENT DOCUMENTS

| | | | | |
|---|---|---|---|---|
| 3,900,664 | A | 8/1975 | Miller | 442/142 |
| 3,956,233 | A | 5/1976 | Fletcher et al. | 260/45.7 |
| 4,001,477 | A | 1/1977 | Economy et al. | 428/224 |
| 4,264,320 | A | 4/1981 | White | 8/194 |
| 4,284,682 | A | 8/1981 | Tschirch et al. | 428/263 |
| 4,651,514 | A | 3/1987 | Collett | 57/227 |
| 4,866,252 | A | 9/1989 | Van Loo et al. | 219/535 |

(Continued)

FOREIGN PATENT DOCUMENTS

| | | |
|---|---|---|
| EP | 1 072 703 | 1/2001 |
| GB | 2 183 682 | 6/1987 |

(Continued)

OTHER PUBLICATIONS

U.S. Appl. No. 13/006,757, filed Jan. 14, 2011, Emery et al.
U.S. Appl. No. 13/091,489, filed Apr. 21, 2011, Emery et al.
U.S. Appl. No. 61/376,711, filed Aug. 25, 2010, Emery et al.

*Primary Examiner* — Jenna L Johnson
(74) *Attorney, Agent, or Firm* — Cheryl J. Brickey

(57) ABSTRACT

A flame resistant fabric containing a plurality of warp elements comprising flame resistant (FR) yarns extending in a warp direction and a plurality of filling elements comprising FR yarns extending in the fill direction transverse to the warp direction in interwoven relation to the warp elements. At least a portion of the FR yarns in the fill and/or warp direction comprise intermingled FR yarns. The intermingled FR yarns contain at least 2 plies, at least one of the plies contain staple fibers or continuous multifilaments and at least one of the plies contain FR fibers. The plies are intermingled together with a portion of the staple fibers or continuous multifilaments of the first ply entangled with the second ply.

20 Claims, 2 Drawing Sheets

(56) References Cited

U.S. PATENT DOCUMENTS

| | | | | |
|---|---|---|---|---|
| 4,918,795 | A | 4/1990 | Dischler | 26/1 |
| 4,927,698 | A | 5/1990 | Jaco et al. | 428/198 |
| 4,958,485 | A | 9/1990 | Montgomery et al. | 57/210 |
| 4,990,793 | A | 2/1991 | Bonigk et al. | 250/571 |
| 4,996,099 | A | 2/1991 | Cooke et al. | 428/245 |
| 5,033,143 | A | 7/1991 | Love, III | 8/158 |
| 5,069,957 | A | 12/1991 | Vandermeersch | 428/230 |
| 5,091,243 | A | 2/1992 | Tolbert et al. | 428/253 |
| 5,140,852 | A | 8/1992 | Bonigk et al. | 73/160 |
| 5,299,602 | A | 4/1994 | Barbeau et al. | 139/420 |
| 5,323,815 | A | 6/1994 | Barbeau et al. | 139/420 |
| 5,399,418 | A | 3/1995 | Hartmanns et al. | 428/218 |
| 5,527,597 | A | 6/1996 | Stanhope et al. | 428/231 |
| 5,694,981 | A | 12/1997 | Stanhope et al. | 139/383 |
| 5,700,573 | A | 12/1997 | McCullough | 428/364 |
| 5,727,401 | A | 3/1998 | Statham | 66/176 |
| 5,824,614 | A | 10/1998 | Gadoury | 442/415 |
| 5,843,542 | A | 12/1998 | Brushafer et al. | 428/36.1 |
| 6,146,759 | A | 11/2000 | Land | 428/370 |
| 6,503,622 | B1 | 1/2003 | Yoshimura et al. | 428/364 |
| 6,546,605 | B1 | 4/2003 | Emery et al. | 28/167 |
| 6,553,749 | B2 | 4/2003 | Land et al. | 57/5 |
| 6,606,846 | B2 | 8/2003 | Land | 57/5 |
| 6,624,096 | B2 | 9/2003 | Thomas et al. | 442/181 |
| 6,685,785 | B1 | 2/2004 | Morris et al. | 156/137 |
| 6,701,703 | B2 | 3/2004 | Patrick | 57/229 |
| 6,974,785 | B1 | 12/2005 | Barbeau et al. | 442/208 |
| 7,124,569 | B2 | 10/2006 | Lee et al. | 57/210 |
| 7,241,709 | B2 | 7/2007 | Chiou et al. | 442/246 |
| 7,393,800 | B2 | 7/2008 | Corner | 442/302 |
| 7,581,376 | B2 | 9/2009 | Simmonds | 57/350 |
| 7,589,036 | B2 | 9/2009 | Corner et al. | 442/301 |
| 7,841,162 | B2 | 11/2010 | Coombs | 57/210 |
| 2003/0221740 | A1 | 12/2003 | Ohara | 139/420 |
| 2003/0228812 | A1 | 12/2003 | Stanhope et al. | 442/49 |
| 2003/0228815 | A1 | 12/2003 | Bhatnagar et al. | 442/164 |
| 2004/0029473 | A1 | 2/2004 | McKee et al. | 442/181 |
| 2004/0034941 | A1 | 2/2004 | Iwato et al. | 8/115.51 |
| 2005/0009428 | A1 | 1/2005 | Porter et al. | 442/129 |
| 2005/0165154 | A1 | 7/2005 | Kosuge et al. | 524/494 |
| 2006/0035553 | A1 | 2/2006 | Bader et al. | 442/239 |
| 2006/0035555 | A1 | 2/2006 | Narayanan et al. | 442/387 |
| 2006/0040580 | A1 | 2/2006 | Ogle et al. | 442/389 |
| 2006/0059634 | A1 | 3/2006 | Tutterow | 8/478 |
| 2006/0089069 | A1 | 4/2006 | Allen, II et al. | 442/189 |
| 2006/0105658 | A1 | 5/2006 | Patz et al. | 442/181 |
| 2006/0116043 | A1 | 6/2006 | Hope et al. | 442/301 |
| 2006/0160454 | A1 | 7/2006 | Handermann et al. | 442/415 |
| 2007/0065685 | A1 | 3/2007 | Bridgeman et al. | 428/920 |
| 2008/0072629 | A1 | 3/2008 | Gehring | 66/202 |
| 2008/0085411 | A1 | 4/2008 | Prickett | 428/365 |
| 2008/0085645 | A1 | 4/2008 | Prickett | 442/123 |
| 2008/0152888 | A1 | 6/2008 | Tutterow et al. | 428/221 |
| 2008/0299854 | A1 | 12/2008 | Hilleary et al. | 442/136 |
| 2008/0299857 | A1 | 12/2008 | Harding et al. | 442/329 |
| 2009/0056029 | A1 | 3/2009 | Hall, III et al. | 5/698 |
| 2009/0181588 | A1 | 7/2009 | Capwell | 442/64 |
| 2010/0009586 | A1 | 1/2010 | Verdu et al. | 442/184 |
| 2011/0010827 | A1 | 1/2011 | Stanhope et al. | 2/458 |

FOREIGN PATENT DOCUMENTS

| | | |
|---|---|---|
| JP | 2005/200803 | 7/2005 |
| WO | WO 87/01140 | 2/1987 |

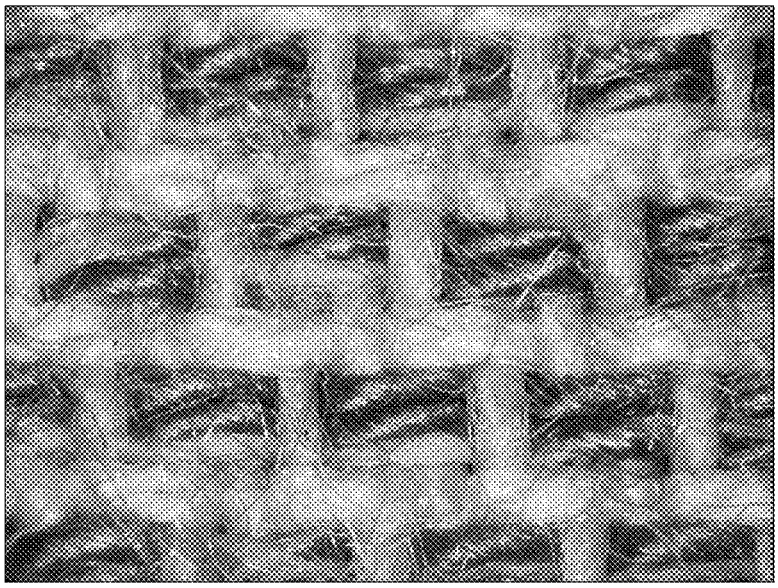
FIG. –1–
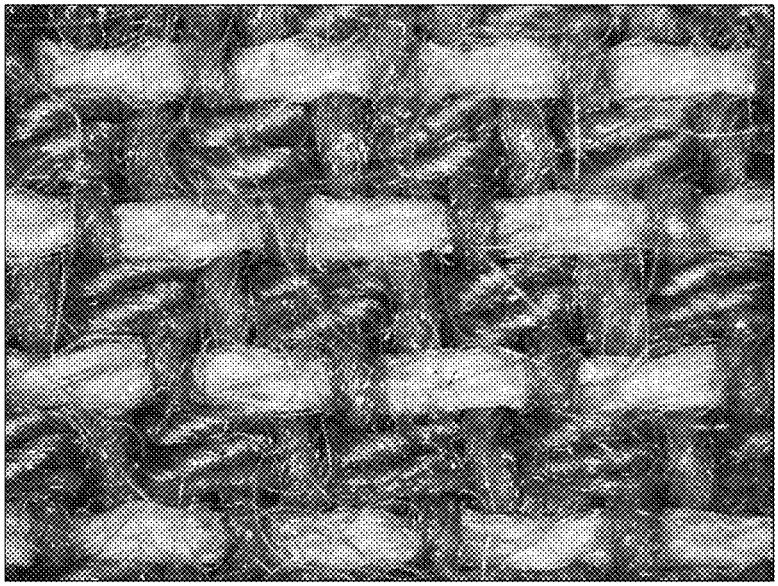
FIG. –2–

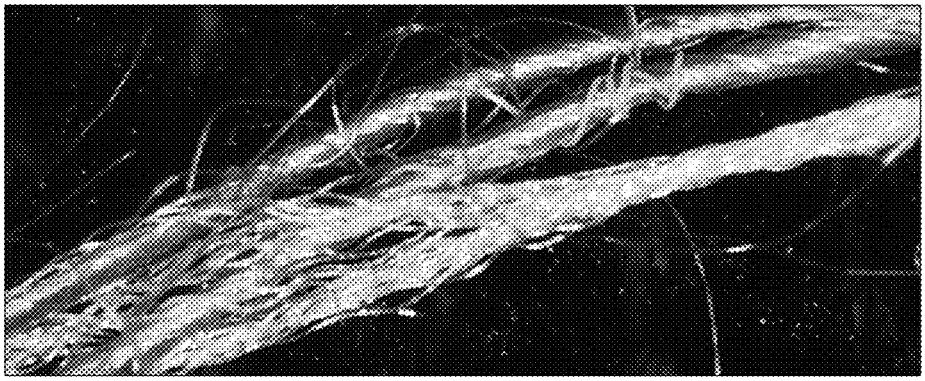
FIG. –3–
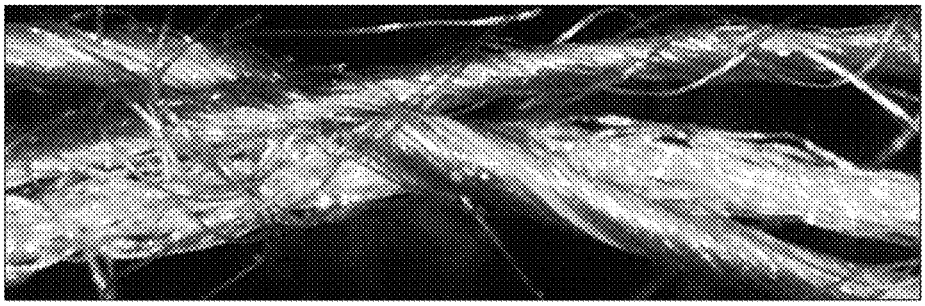
FIG. –4–
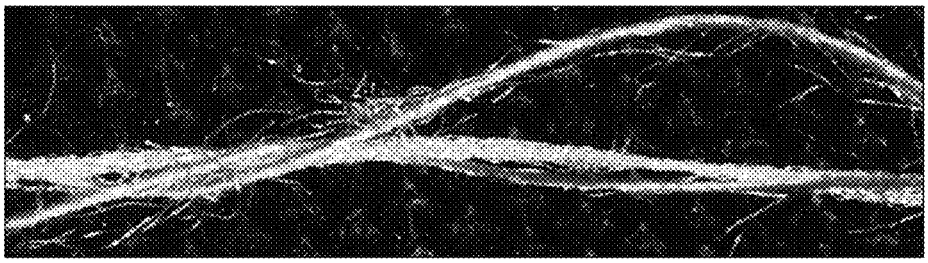
FIG. –5–

FLAME RESISTANT FABRIC HAVING INTERMINGLES FLAME RESISTANT YARNS

RELATED APPLICATIONS

This application is a continuation of co-pending U.S. patent application Ser. No. 13/604,180, "Flame Resistant Fabric Having Intermingled Flame Resistant Yarns" filed on Sep. 5, 2012, which is a continuation of co-pending U.S. patent application Ser. No. 13/190,550, "Flame Resistant Fabric Having Intermingled Flame Resistant Yarns" filed on Jul. 26, 2011, both of which are herein incorporated by reference in their entirety.

FIELD OF THE INVENTION

The present invention generally relates to flame resistant fabrics.

BACKGROUND

For the military, firefighters, foundry workers and other workers whose occupations expose them to extreme heat and fire, safety is a paramount concern. Working in and around environments wherein one is exposed to extreme heat and fire continually subjects workers to risks of being seriously burned. Accordingly, it is a necessity that the clothing of such military workers and other personnel provide a high degree of heat and fire resistance protection to protect such workers against the hazards of their work environments.

In attempting to provide maximum protection against heat and fire, the emphasis has been on using thermal and/or flame resistant fabrics to form protective garments such as firefighter's turnout coats, pants, etc. The flame resistant fabrics used for such garments typically are formed of woven inherently flame resistant yarns and are thick, heavy and stiff and are assembled in multiple layers to form the garments. The stiffness and general inflexibility of such fabrics tends to cause another significant problem which is the restriction of freedom of movement of a worker while wearing garments made from such fabrics. By restricting the freedom of movement of the wearer, further stress is placed upon and greater exertion is required from the wearer in order to move and work in the protective garments. Accordingly it can be seen that a need exists for better flame resistant fabrics.

BRIEF SUMMARY

A flame resistant fabric containing a plurality of warp elements comprising flame resistant (FR) yarns extending in a warp direction and a plurality of filling elements comprising FR yarns extending in the fill direction transverse to the warp direction in interwoven relation to the warp elements. At least a portion of the FR yarns in the fill and/or warp direction comprise intermingled FR yarns. The intermingled FR yarns contain at least 2 plies, at least one of the plies contain staple fibers or continuous multifilaments and at least one of the plies contain FR fibers. The plies are intermingled together with a portion of the staple fibers or continuous multifilaments of the first ply entangled with the second ply.

BRIEF DESCRIPTION OF THE DRAWINGS

FIGS. 1 and 2 are micrographs of a woven fabric containing an intermingled yarn.

FIGS. 3, 4, and 5 are micrographs of an intermingled yarn at 80×, 90×, and 20× magnification respectively.

DETAILED DESCRIPTION

"Flame resistant", in this application means a material that provides a thermal barrier and reduces body burn as described in NFPA 1971 and allows the user time to escape the flames and/or fire. Such a fabric would preferably resist ignition and be self-extinguishing. "Elastic", in this application is defined as meaning that the yarn elongates under normal forces of wearing a garment. "Non-elastic", in this application is defined as meaning that the yarn that does not elongate significantly under normal forces of wearing a garment. The fabric of the invention serves to provide flame resistance and optionally stretch. This fabric may be used in any suitable application, including but not limited to garments, suspenders, furniture, and structural elements such as tenting. "Wrapping yarns" and "Wrapped yarns", in this application, means covering a core yarn(s) with additional yarns by twisting "wrapping yarns" around an already formed core. This wrapping does not necessary mean that the core yarn is completely covered by the wrapping yarns, but is at least partially covered by the wrapping yarns.

FIGS. 1 and 2 are micrographs of woven flame resistant fabrics that contain an intermingled yarn. The flame resistant fabrics shown contain a plurality of warp elements comprising flame resistant (FR) yarns extending in a warp direction and a plurality of filling elements comprising FR yarns extending in the fill direction transverse to the warp direction in interwoven relation to the warp elements. In the fabrics of FIGS. 1 and 2, a portion of the FR yarns in the fill direction comprise intermingled FR yarns.

These intermingled FR yarns contain at least 2 plies, at least one of the plies contain staple fibers or continuous multifilaments and at least one of the plies contain FR fibers. The at least two plies are intermingled together, at least a portion of the staple fibers or continuous multifilaments of the first ply are entangled in the second ply. In one embodiment, the plies are intermingled using a process that combines spun yarns and filament yarn(s) through air entanglement of the spun yarns with the filament yarn. In the intermingled FR yarns shown in the fabrics in FIGS. 1 and 2, the intermingled yarns contain 3 plies, a first ply containing continuous multifilament, non-elastic thermoplastic fibers, a second ply containing FR staple fibers and a third ply containing FR staple fibers.

The flame resistant fabric may be of any suitable construction including woven, non-woven, and knit. In one embodiment, the filling elements extend in a fill direction transverse to the warp direction and are interwoven with the warp elements. Preferably, the fabric is a woven fabric and may be constructed of any weave such as plain, satin, or twill weave.

The warp and filling elements may be any suitable yarn and material. In one embodiment, the warp elements are FR yarns. In another embodiment, the filling elements are FR yarns. In another embodiment, both the warp elements and the filling elements are FR yarns. The FR yarn used in the warp direction may be the same or different to the FR yarn used in the fill direction. Further, more than one type of FR yarn may be used in the warp and/or fill direction, randomly or in a set pattern.

The FR yarns for the warp and fill elements may by any suitable FR yarn. The yarns may be flame resistant due to the inherent FR nature of the yarn or may be due to FR chemicals applied as an additive or coating in or on the yarn.

The FR treatment of the yarns to make the yarns FR may be conducted on the fibers before the fibers are formed into yarns, on the yarns before being formed into a fabric, or on the fabric (and therefore yarns) after fabric formation. If the yarn is not inherently FR, then the yarn is not considered FR until it is treated with the FR chemistries.

Any suitable flame resistant fibrous materials could be used including, but not limited to: aramids, meta-aramids, FR rayon, FR polynosic rayon, flame resistant cellulosics such as flame resistant cotton or acetate, flame resistant polyester, FR polyvinyl alcohol, polytetrafluoroethylene, flame resistant wool, polyvinyl chloride, polyetheretherketone, polyetherimide, polyethersulfone, polychlal, polyimide, polyamide, polyimideamide, polyolefin, polybenzoxazole, carbon, modacrylic acrylic, melamine, glass, NOMEX™, or any other flame resistant materials that can be used for the manufacture of fabrics for garments or other textile applications. "FR cotton" means that the cotton yarns are treated with an FR additive or coating (this can be before or after fabric formation).

In on embodiment, the FR warp and/or fill yarns are a multi-component FR yarn. Preferably, the multi-component FR warp yarn contains an FR fiber (preferably FR treated cotton) and a non-FR fiber having a melting temperature less than 300° C., more preferably less than 265° C. The non-FR fiber is preferably a thermoplastic. Thermoplastic fibers are typically considered non-FR as they do not form char and can melt and drip. However, they provide desirable characteristics like strength and abrasion resistance. The combination of thermoplastic and non-thermoplastic components provides a good balance of strength and FR. Preferably, this multi-component yarn is a blend of FR treated nylon/cotton. In one embodiment, the nylon/cotton is in a 52%/48% by weight ratio treated with a FR chemistry.

The flame resistant fabric further comprises intermingled FR yarns. At least a portion of the FR yarns in the fabric are intermingled FR yarns. In one embodiment, the at least a portion of the FR yarns in the warp direction and/or at least a portion of the FR yarns in the fill direction are intermingled FR yarns.

In one embodiment, all of the FR yarns in the warp direction are intermingled FR yarns. In another embodiment, all of the FR yarns in the fill direction are intermingled FR yarns. The intermingled FR yarns may be placed in the warp and/or fill direction randomly or in a repeating pattern. In one embodiment, the intermingled FR yarns are in an amount of between about 30 and 80% of the yarns in the warp direction. In another embodiment, the intermingled FR yarns are in an amount of between about 30 and 80% of the yarns in the fill direction. In one embodiment, the intermingled FR yarns are placed in an alternating arrangement with the FR yarns in the warp and/or fill direction. The alternating arrangement may be any suitable repeating pattern for example, 1:1, 2:1, 1:2, 2:2, 3:1, 1:3, 2:3, 3:2, 3:3, 4:2, 2:4, 5:1, and 1:5 (a 3:1 arrangement means that there are 3 intermingled FR yarns, then one FR yarn, then three intermingled FR wrapped yarns, . . . ).

The intermingled FR yarn contains at least 2 plies that are intermingled together. In another embodiment, the intermingled FR yarn contains at least 3 plies that are intermingled together. At least one ply comprises staple fibers or continuous multifilaments. In one embodiment, at least one ply comprises staple fibers. In another embodiment, at least one ply comprises continuous multifilaments. Having at least one ply containing continuous multifilaments give structural strength to the yarn during fabric formation. In another embodiment, the intermingled FR yarn contains at least one ply of staple fibers and at least one ply of continuous multifilaments.

At least a portion of the staple fibers or continuous multifilament fibers of the first ply of the intermingled FR yarn are entangled in the second ply. This is preferably done by air-intermingling. The individual plies of the intermingled yarn are sufficiently intermingled that the yarn has an integrity and unity of construction suitable for knitting, weaving, or otherwise intertwining, to form a fabric.

In the case of the intermingled yarn having at least one ply of continuous multifilaments and at least one ply of staple fibers, the air serves to open the continuous multifilaments and some of the staple fibers are pushed into the open continuous multifilaments. Typically, the resultant intermingled yarn still contains distinct plies which are attached together rather than resulting in an intermingled yarn where the individual plies cannot be separated or seen. This can be seen for example, in FIGS. 3, 4, and 5 which show an intermingled yarn having three plies, one having continuous multifilaments and two having staple fibers. FIG. 3 is at 80× magnification, FIG. 4 is at 90× magnification, and FIG. 5 is at 20× magnification.

In one embodiment, at least one of the plies of the intermingled yarn contains continuous elastic fibers. These may be monofilament or multifilament. Preferably, when elastic fibers are present in the intermingled yarn, at least one other ply of the yarn contains non-elastic continuous multifilaments. This allows easier processing on some air-entangling machinery.

In one embodiment, the intermingled yarn comprises all FR fibers. In another embodiment, at least one ply of the intermingled yarn comprises non-FR fibers, the non-FR fibers preferably formed from a thermoplastic material or a thermoset material.

In one embodiment, at least one ply of the intermingled yarn comprises a thermoplastic material. When exposed to flame and/or heat, the thermoplastic material will melt but the fabric still will retain flame resistance protection due to the interweaving of the FR warp and fill yarns, and FR components of the intermingled yarns. In another embodiment, at least one ply of the intermingled yarn comprises a thermoset material. When exposed to flame and/or heat, the thermoset material will not melt reducing the risk that the wearer of the fabric be burned by melted polymer. In one embodiment, the thermoset material is rayon, for example LISIL™, or PVA (polyvinyl acetate).

In the embodiments where the intermingled yarn contains non-FR fibers, the intermingled yarn comprises at least 30% wt, at least 40% wt, or at least 60% wt of FR fibers. In another embodiment, the intermingled yarn preferably contains between about 10 and 90% wt, 25 to 75% wt, or 50 to 80% wt FR fibers.

In one embodiment, at least a portion of the fibers are not solution dyed. In another embodiment, at least a portion of the fibers are solution dyed. In another embodiment, the FR fibers (such as Nomex®) are solution dyed. While not being bound to any particular theory, it is believed that solution dying FR fibers such as Nomex® produces fibers with lower flame shrinkage than natural Nomex® because of higher crystallinity. Lower shrinkage may contribute to a larger insulating air gap in PyroMan testing and better performance. Preferably, the FR fibers are heat treated to increase the crystallinity compared to non-heat treated FR fibers.

In another embodiment, at least 2 of the plies in the intermingled yarn have differential thermal shrinkage. While not being bound to any theory, it is believed that when a fabric formed from an intermingled fiber having a differential thermal shrinkage plies is exposed to heat, the plies shrinkage at different rates and/or amounts causing bulking of the fabric. This may lead to better heat and flame protection to the user. In one embodiment, the plies (comparing the first ply and the second ply) have a shrinkage differential in an amount greater than about 0.25, greater than about 0.5, greater than about 1, greater than about 2, or greater than about 4.5. This differential is calculated by comparing the percentage of shrinkage of the ply with the greater amount of shrinkage to the percentage of shrinkage of the ply with the lesser amount of shrinkage after PyroMan testing. For example, if the intermingled yarn contained a two plies each at 100 length units before PyroMan testing and after testing the first ply had a length of 90 units and the second ply had a length of 80 units, the shrinkage differential would be 20%/10% which is 2.

The entangling of the fibers between the plies of the intermingled fiber may be entangled along approximately the entire length of the yarn or in distinct regions along the yarn. This may be done using a process that combines spun yarns and filament yarn(s) through air entanglement of the spun yarns with the filament yarn. The air entanglement may be continuous along the length of the yarn or may be at discrete portions along the yarn.

In one embodiment, the compositions of the intermingled yarns in the warp or fill direction vary. This means that the fabric contains intermingled yarns in the warp or fill direction that have different compositions as compared to other intermingled yarns in the same fabric direction. In another embodiment, the composition of the intermingled yarn in the warp direction is different than the composition of the intermingled yarn in the fill direction. This composition difference can be types of fibers used (staple versus continuous), polymer, number of plies, etc.

In one embodiment, the intermingled yarn has essentially no twist, defined as less than 2 twists per inch. In another embodiment, the intermingled yarn has a false twist and in another embodiment, the intermingled yarn contains little twist (between about 2 to 10 twists per inch).

In the embodiments where the intermingled yarn contains non-FR fibers, the non-FR yarn is not covered by the FR fibers but would be exposed to heat and/or flame. This "openness" of the yarn may be seen, for example, in FIGS. 3-5.

In one embodiment, the flame resistant fabric may also contain an FR wrapped yarn. The FR wrapped yarn contains a core and a wrapping yarn. In one embodiment, the wrapping yarns are formed from the same FR yarn as the other FR yarns in the fill and/or warp direction. The core of the wrapped yarn may or may not have inherent stretch. Preferably, the core is elastic. The core in general is formed from an elastic material such as rubber, or SPANDEX™ (which is a polyurethane-polyurea copolymer) or similar elastic materials that have an inherent stretchability or elasticity. The core may be a fiber, yarn, filament, or any other suitable material for use in the end product. The size of the core is a matter of choice based upon factors of the amount of stretchability and the quality of the finished fabric for forming a garment. Generally, the core yarns will be in a range of 40 to 70 denier, which translates to approximately 6 to 14% of the weight of the wrapped yarns being SPANDEX™ or other elastic material. In another embodiment, the core yarns will be less than 40 denier, less than 35 denier, less than 30 denier, or between 20 and 25 denier. In another embodiment, the core yarns will be greater than 70 denier, greater than 75 denier, greater than 80 denier, or between 80 and 200 denier.

The wrapping yarns are wrapped about the core at approximately 5 to 35 turns per inch, preferably 15 to 25 turns per inch. It also is possible for the wrapping yarns to be wrapped about the core yarns in fewer or greater turns per inch as desired as long as the wrapping yarn covers at least a portion of the core. The number of wraps is dependent on the size of the wrapping yarns as the larger the wrapping yarns, the fewer wraps or twists per inch are needed to ensure partial coverage. In one embodiment, it is preferred to only have partial coverage or incomplete coverage.

In another embodiment, the wrapped yarn contains one FR wrapping yarn that is wrapped around an elastic core. In another embodiment, the wrapped yarn contains at least two twisted FR wrapping yarns that are then wrapped around an elastic core. The FR wrapping yarns are twisted around themselves (or are otherwise entangled) before being twisted with the core.

In one preferred embodiment, the flame resistant fabric contains a plurality of warp elements comprising flame resistant (FR) yarns extending in a warp direction and a plurality of filling elements comprising FR yarns extending in the fill direction transverse to the warp direction in interwoven relation to the warp elements. At least a portion of the FR yarns in the fill direction and/or the warp direction comprise intermingled FR yarns. The intermingled FR yarns comprise three plies: the first ply comprises continuous multifilament fibers, the second ply comprises staple FR fibers, and the third ply comprises staple FR fibers. The FR fibers and the non-FR fibers of the intermingled yarn have differential thermal shrinkage, and the three plies are intermingled together where the staple fibers of the second and third plies are entangled in the continuous multifilaments of the second ply.

After the warp yarns and filling yarns have been interwoven to form the FR fabric, the fabric may optionally be subjected to a finishing application. During finishing, the fabric may be scoured by applying a detergent and water bath to the fabric. After scouring, a finish may optionally be applied to the fabric. In the preferred embodiment, the finish is a moisture repellant or an FR treatment. In one embodiment, the fabric is scoured, then printed or dyed, then subjected to an FR treatment and/or other finish treatments. It is possible, however, to use other types of finishes or materials, including hydrophilic or other types of material.

As noted above, the invention also provides textile materials that have been treated with one or more flame retardant treatments or finishes to render the textile materials more flame resistant. Typically, such flame retardant treatments or finishes are applied to a textile material containing cellulosic fibers in order to impart flame resistant properties to the cellulosic portion of the textile material. In such embodiments, the flame retardant treatment or finish can be any suitable treatment. Suitable treatments include, but are not limited to, halogenated flame retardants (e.g., brominated or chlorinated flame retardants), phosphorous-based flame retardants, antimony-based flame retardants, nitrogen-containing flame retardants, and combinations, mixtures, or blends thereof.

In one preferred embodiment, the textile material comprises cellulosic fibers and has been treated with a phosphorous-based flame retardant treatment. In this embodiment, a tetrahydroxymethyl phosphonium salt, a condensate of a tetrahydroxymethyl phosphonium salt, or a mixture thereof is first applied to the textile material. As utilized herein, the term "tetrahydroxymethyl phosphonium salt" refers to salts containing the tetrahydroxymethyl phosphonium (THP) cation, which has the structure

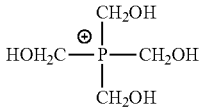

including, but not limited to, the chloride, sulfate, acetate, carbonate, borate, and phosphate salts. As utilized herein, the term "condensate of a tetrahydroxymethyl phosphonium salt" (THP condensate) refers to the product obtained by reacting a tetrahydroxymethyl phosphonium salt, such as those described above, with a limited amount of a cross-linking agent, such as urea, guanazole, or biguanide, to produce a compound in which at least some of the individual tetrahydroxymethyl phosphonium cations have been linked through their hydroxymethyl groups. The structure for such a condensate produced using urea is set forth below

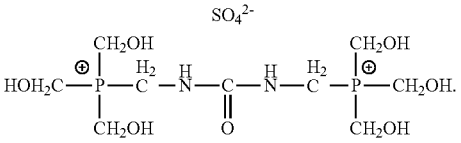

The synthesis of such condensates is described, for example, in Frank et al. (*Textile Research Journal*, November 1982, pages 678-693) and Frank et al. (*Textile Research Journal*, December 1982, pages 738-750). These THPS condensates are also commercially available, for example, as PYROSAN® CFR from Emerald Performance Materials.

The THP or THP condensate can be applied to the textile material in any suitable amount. Typically, the THP salt or THP condensate is applied to the textile material in an amount that provides at least 0.5% (e.g., at least 1%, at least 1.5%, at least 2%, at least 2.5%, at least 3%, at least 3.5%, at least 4%, or at least 4.5%) of elemental phosphorus based on the weight of the untreated textile material. The THP salt or THP condensate is also typically applied to the textile in an amount that provides less than 5% (e.g., less than 4.5%, less than 4%, less than 3.5%, less than 3%, less than 2.5%, less than 2%, less than 1.5%, or less than 1%) of elemental phosphorus based on the weight of the untreated textile material. Preferably, the THP salt or THP condensate is applied to the textile material in an amount that provides about 1% to about 4% (e.g., about 1% to about 3% or about 1% to about 2%) of elemental phosphorous based on the weight of the untreated textile material.

Once the THP salt or THP condensate has been applied to the textile material, the THP salt or THP condensate is then reacted with a cross-linking agent. The product produced by this reaction is a cross-linked phosphorus-containing flame retardant polymer. The cross-linking agent is any suitable compound that enables the cross-linking and/or curing of THP. Suitable cross-linking agents include, for example, urea, a guanidine (i.e., guanidine, a salt thereof, or a guanidine derivative), guanyl urea, glycoluril, ammonia, an ammonia-formaldehyde adduct, an ammonia-acetaldehyde adduct, an ammonia-butyraldehyde adduct, an ammonia-chloral adduct, glucosamine, a polyamine (e.g., polyethyleneimine, polyvinylamine, polyetherimine, polyethyleneamine, polyacrylamide, chitosan, aminopolysaccharides), glycidyl ethers, isocyanates, blocked isocyanates and combinations thereof. Preferably, the cross-linking agent is urea or ammonia, with urea being the more preferred cross-linking agent.

The cross-linking agent can be applied to the textile material in any suitable amount. The suitable amount of cross-linking agent varies based on the weight of the textile material and its construction. Typically, the cross-linking agent is applied to the textile material in an amount of at least 0.1% (e.g., at least 1%, at least 2%, at least 3%, at least 5%, at least 7%, at least 10%, at least 15%, at least 18%, or at least 20%) based on the weight of the untreated textile material. The cross-linking agent is also typically applied to the textile material in an amount of less than 25% (e.g., less than 20%, less than 18%, less than 15%, less than 10%, less than 7%, less than 5%, less than 3%, or less than 1%) based on the weight of the untreated textile material. In a potentially preferred embodiment, the cross-linking agent is applied to the textile material in an amount of about 2% to about 7% based on the weight of the untreated textile material.

In order to accelerate the condensation reaction of the THP salt or THP condensate and the cross-linking agent, the above-described reaction can be carried out at elevated temperatures. The time and elevated temperatures used in this curing step can be any suitable combinations of times and temperatures that result in the reaction of the THP or THP condensate and cross-linking agent to the desired degree. The time and elevated temperatures used in this curing step can also promote the formation of covalent bonds between the cellulosic fibers and the phosphorous-containing condensation product, which is believed to contribute the durability of the flame retardant treatment. However, care must be taken not to use excessively high temperatures or excessively long cure times that might result in excessive reaction of the flame retardant with the cellulosic fibers, which might weaken the cellulosic fibers and the textile material. Furthermore, it is believed that the elevated temperatures used in the curing step can allow the THP salt or THP condensate and cross-linking agent to diffuse into the cellulose fibers where they react to form a cross-linked phosphorus-containing flame retardant polymer within the fibers. Suitable temperatures and times for this curing step will vary depending upon the curing oven used and the speed with which heat is transferred to the textile material, but suitable conditions can range from temperatures of about 149° C. (300° F.) to about 177° C. (350° F.) and times from about 1 minute to about 3 minutes.

In the case where ammonia is used as the cross-linking agent, it is not necessary to use elevated temperatures for the THP salt or THP condensate and cross-linking agent to react. In such case, the reaction can be carried out, for example, in a gas-phase ammonia chamber at ambient temperature. A suitable process for generating a phosphorous-based flame retardant using this ammonia-based process is described, for example, in U.S. Pat. No. 3,900,664 (Miller), the disclosure of which is hereby incorporated by reference.

After the THP salt or THP condensate and cross-linking agent have been cured and allowed to react to the desired degree, the resulting textile material can be exposed to an oxidizing agent. While not wishing to be bound to any particular theory, it is believed that this oxidizing step converts the phosphorous in the condensation product (i.e., the condensation product produced by the reaction of the THP salt or THP condensate and cross-linking agent) from a trivalent form to a more stable pentavalent form. The resulting phosphorous-containing compound (i.e., cross-linked, phosphorous-containing flame retardant polymer) is believed to contain a plurality of pentavalent phosphine oxide groups. In those embodiments in which urea has been used to cross-link the THP salt or THP condensate, the phosphorous-containing compound comprises amide linking groups covalently bonded to the pentavalent phosphine oxide groups, and it is believed that at least a portion of the phosphine oxide groups have three amide linking groups covalently bonded thereto.

The oxidizing agent used in this step can be any suitable oxidant, such as hydrogen peroxide, sodium perborate, or sodium hypochlorite. The amount of oxidant can vary depending on the actual materials used, but typically the oxidizing agent is incorporated in a solution containing at least 0.1% concentration (e.g., at least 0.5%, at least 0.8, at least 1%, at least 2%, or at least 3% concentration) and less than 20% concentration (e.g., less than 15%, less than 12%, less than 10%, less than 3%, less than 2%, or less than 1% concentration) of the oxidant.

After contacting the treated textile material with the oxidizing agent, the cured textile material preferably is contacted with a neutralizing solution (e.g., a caustic solution with a pH of at least 8, at least pH 9, at least pH 10, at least pH 11, or at least pH 12). The actual components of the caustic solution can widely vary, but suitable components include any strong base, such as alkalis. For example, sodium hydroxide (soda), potassium hydroxide (potash), calcium oxide (lime), or any combination thereof can be used in the neutralizing solution. The amount of base depends on the size of the bath and is determined by the ultimately desired pH level. A suitable amount of caustic in the solution is at least 0.1% concentration (e.g., at least 0.5%, at least 0.8, at least 1%, at least 2%, or at least 3% concentration) and is less than 10% concentration (e.g., less than 8%, less than 6%, less than 5%, less than 3%, less than 2%, or less than 1% concentration). The contact time of the treated textile material with the caustic solution varies, but typically is at least 30 seconds (e.g., at least 1 min, at least 3 min, at least 5 min, or at least 10 min). If desired, the neutralizing solution can be warmed (e.g., up to 75° C., up to 70° C., up to 60° C., up to 50° C., up to 40° C., up to 30° C. relative to room temperature).

If desired, the textile material can be treated with one or more softening agents (also known as "softeners") to improve the hand of the treated textile material. The softening agent selected for this purpose should not have a deleterious effect on the flammability of the resultant fabric. Suitable softeners include polyolefins, ethoxylated alcohols, ethoxylated ester oils, alkyl glycerides, alkylamines, quaternary alkylamines, halogenated waxes, halogenated esters, silicone compounds, and mixtures thereof.

To further enhance the textile material's hand, the textile material can optionally be treated using one or more mechanical surface treatments. A mechanical surface treatment typically relaxes stress imparted to the fabric during curing and fabric handling, breaks up yarn bundles stiffened during curing, and increases the tear strength of the treated fabric. Examples of suitable mechanical surface treatments include treatment with high-pressure streams of air or water (such as those described in U.S. Pat. Nos. 4,918,795, 5,033,143, and 6,546,605), treatment with steam jets, needling, particle bombardment, ice-blasting, tumbling, stone-washing, constricting through a jet orifice, and treatment with mechanical vibration, sharp bending, shear, or compression. A sanforizing process may be used instead of, or in addition to, one or more of the above processes to improve the fabric's hand and to control the fabric's shrinkage. Additional mechanical treatments that may be used to impart softness to the treated fabric, and which may also be followed by a sanforizing process, include napping, napping with diamond-coated napping wire, gritless sanding, patterned sanding against an embossed surface, shot-peening, sand-blasting, brushing, impregnated brush rolls, ultrasonic agitation, sueding, engraved or patterned roll abrasion, and impacting against or with another material, such as the same or a different fabric, abrasive substrates, steel wool, diamond grit rolls, tungsten carbide rolls, etched or scarred rolls, or sandpaper rolls.

Additionally, if desired, the fabric can be dyed to give the fabric a desired hue, tint, or pattern. The dyeing of the fabric generally is done following the scouring of the fabric and prior to the application of the finish.

EXAMPLES

Each fabric of the examples was sewn into whole garments, sewn to FR-ACU specification. The warp of the fabric was in the length of the body and the filling was around the width of the body for military printed fabrics. The Pyroman testing (ASTM 1930) results listed were conducted on the garments.

Example 1

An FR fabric was obtained from Milliken & Co branded ABRAMS®. The fabric had a 17/1 52/48 nylon/cotton warp with 30/2 NOMEX™ filling construction. The NOMEX™ yarn was not solution dyed. The entire fabric treated with a phosphorous FR chemistry. The fabric was a 3×1 twill. The finished weight of the fabric was approximately 6.9 oz/yd$^2$. PyroMan results for an FR Army Combat Uniform (ACU) garment, excluding head: 2$^{nd}$ degree 22.3%, 3$^{rd}$ degree 1.7%, total 24.0%.

Example 2

Example 2 was the same construction as Example 1, except the filling is an alternating arrangement of one pick of 40/2 NOMEX™ twisted around one 70d SPANDEX™ pick and pick with 40/2 NOMEX™ yarns. The NOMEX™ yarn was solution dyed. The number of warp ends was different in the greige from Example 1. The fabric of Example 2 was finished with a phosphorous-based flame retardant treatment and made into FR ACU garments that were then burned on the instrumented mannequin. The finished weight of the fabric was approximately 6.2 oz/yd$^2$. Averaged PyroMan test results excluding head were: 2nd degree 21.3%, 3$^{rd}$ degree 0.0%, total 21.3%.

Example 3

Example 3 was the same construction as Example 1, except that each pick of the filling contained two 30/1 NOMEX™ yarns inserted together, but not intermingled or twisted together. The NOMEX™ yarn was not solution dyed. The number of warp ends was different in the greige from Example 1. The fabric of Example 3 was finished with a phosphorous-based flame retardant treatment and made into FR ACU garments that were then burned on the instrumented mannequin. The finished weight of the fabric was approximately 6.1 oz/yd$^2$. Averaged PyroMan test results excluding head were: 2nd degree 21.3%, 3$^{rd}$ degree 2.9%, total 24.2%.

Example 4

Example 4 was the same construction as Example 1, except the filling is an alternating arrangement of one pick of a 3 ply intermingled yarn pick and pick with 30/2 NOMEX™ yarns.

The intermingled yarn was produced using a process that combines spun yarns and filament yarn(s) through air entanglement of the spun yarns with the filament yarn and contained two 30/1 NOMEX™ yarns and one 70d Nylon filament yarn. The NOMEX™ yarn was solution dyed. The number of warp ends was different in the greige from Example 1.

The fabric of Example 4 was finished with a phosphorous-based flame retardant treatment and made into FR ACU garments that were then burned on the instrumented mannequin. The finished weight of the fabric was approximately 7.3 oz/yd$^2$. Averaged PyroMan test results excluding head were: 2nd degree 8.2%, 3$^{rd}$ degree 0.0%, total 8.2%.

Example 5

Example 5 was the same construction as Example 4, except the NOMEX™ yarn was not solution dyed. The finished weight of the fabric was approximately 7.2 oz/yd$^2$. Averaged PyroMan test results excluding head were: 2nd degree 14.8%, 3$^{rd}$ degree 2.1%, total 16.9%.

Example 6

Example 6 was the same construction as Example 1, except the filling is an alternating arrangement of one pick of a 4 ply intermingled yarn pick and pick with 30/2 NOMEX™ yarns.

The intermingled yarn was produced using a process that combines spun yarns and filament yarn(s) through air entanglement of the spun yarns with the filament yarn and contained two 30/1 NOMEX™ yarns, one 40d filament nylon and one 40d spandex yarn. The NOMEX™ yarn was solution dyed. The number of warp ends was different in the greige from Example 1.

The fabric of Example 4 was finished with a phosphorous-based flame retardant treatment and made into FR ACU garments that were then burned on the instrumented mannequin. The finished weight of the fabric was approximately 7.0 oz/yd$^2$. Averaged PyroMan test results excluding head were: 2nd degree 11.0%, 3$^{rd}$ degree 0.4%, total 11.4%.

Example 7

Example 7 was the same construction as Example 1, except the filling is an alternating arrangement of one pick of a 3 ply intermingled yarn pick and pick with a double covered yarn.

The double covered yarn contained two 30/1 NOMEX™ yarns wrapped around one 40d SPANDEX™ fiber. One ply of the 30/1 NOMEX™ was wrapped in the s direction and one of the 30/1 NOMEX™ was wrapped in the z direction.

The intermingled yarn was produced using a process that combines spun yarns and filament yarn(s) through air entanglement of the spun yarns with the filament yarn and contained two 30/1 NOMEX™ yarns and one 70d filament nylon yarn. The NOMEX™ yarn was not solution dyed. The number of warp ends was different in the greige from Example 1.

The fabric of Example 7 was finished with a phosphorous-based flame retardant treatment and made into FR ACU garments that were then burned on the instrumented mannequin. The finished weight of the fabric was approximately 7.1 oz/yd$^2$. Averaged PyroMan test results excluding head were: 2nd degree 13.9%, 3$^{rd}$ degree 1.2%, total 15.1%.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A flame resistant fabric comprising:

a plurality of warp elements comprising warp flame resistant (FR) yarns extending in a warp direction and wherein the warp FR yarns comprise FR-treated cellulosic fibers;

a plurality of filling elements comprising filling FR yarns and intermingled FR yarns extending in the fill direction transverse to the warp direction in interwoven relation to the warp elements, wherein the filling elements comprise between about 30 and 80% by number of yarns of intermingled FR yarns, and wherein the intermingled FR yarns and the filling FR yarns are arranged in an intermingled FR yarn:filling FR yarn alternating repeating pattern in the fill direction selected from the group consisting of 1:1, 2:1, 1:2, 2:2, 3:1, 2:3, 3:2, 3:3, 4:2, and 2:4;

wherein the intermingled FR yarns comprise a length and at least three plies, wherein the first ply comprises continuous multifilament fibers, the second ply comprises staple FR fibers, and the third ply comprises staple FR fibers, wherein the first ply and the second ply have differential thermal shrinkage, wherein the intermingled FR yarns comprise distinct and discrete entanglement regions and non-entanglement regions along the length of the yarn, wherein in the entanglement regions the three plies are intermingled together where the staple fibers of the second and third plies are entangled in the continuous multifilaments of the first ply.

2. The flame resistant fabric of claim 1, wherein at least one ply of the intermingled FR yarn comprises continuous elastic multifilaments.

3. The flame resistant fabric of claim 1, wherein at least one ply of the intermingled FR yarn comprises a thermoplastic or thermoset material.

4. A garment comprising the fabric of claim 1.

5. The flame resistant fabric of claim 1, wherein the warp elements further comprise a plurality of intermingled FR yarns.

6. A flame resistant fabric comprising:

a plurality of warp elements comprising warp flame resistant (FR) yarns and intermingled FR yarns extending in a warp direction, wherein the warp FR yarns comprise a blend of nylon and FR-treated cotton fibers, and wherein the warp elements comprise between about 30 and 80% by number of yarns of intermingled FR yarns, and wherein the intermingled FR yarns and the warp FR yarns are arranged in an intermingled FR yarn:warp FR yarn alternating repeating pattern in the warp direction selected from the group consisting of 1:1, 2:1, 1:2, 2:2, 3:1, 2:3, 3:2, 3:3, 4:2, and 2:4;

a plurality of filling elements comprising filling FR yarns extending in the fill direction transverse to the warp direction in interwoven relation to the warp elements and wherein the filling FR yarns comprise FR-treated cellulosic fibers;

wherein the intermingled FR yarns comprise a length and at least three plies, wherein the first ply comprises continuous multifilament fibers, the second ply comprises staple FR fibers, and the third ply comprises staple FR fibers, wherein the first ply and the second ply have differential thermal shrinkage, wherein the intermingled FR yarns comprise distinct and discrete entanglement regions and non-entanglement regions along the length of the yarn, wherein in the entanglement regions the three plies are intermingled together where the staple fibers of the second and third plies are entangled in the continuous multifilaments of the first ply.

7. The flame resistant fabric of claim 6, wherein at least one ply of the intermingled FR yarn comprises continuous elastic multifilaments.

8. The flame resistant fabric of claim 6, wherein at least one ply of the intermingled FR yarn comprises a thermoplastic or thermoset material.

9. The flame resistant fabric of claim 6, wherein the filling elements further comprise a plurality of intermingled FR yarns.

10. A garment comprising the fabric of claim 6.

11. A flame resistant fabric comprising:

a plurality of warp elements comprising warp flame resistant (FR) yarns extending in a warp direction and wherein the warp FR yarns comprise FR-treated cellulosic fibers;

a plurality of filling elements comprising filling FR yarns and intermingled FR yarns extending in the fill direction transverse to the warp direction in interwoven relation to the warp elements, wherein the filling elements comprise between about 30 and 80% by number of yarns of intermingled FR yarns, and wherein the intermingled FR yarns and the filling FR yarns are arranged in an intermingled FR yarn:filling FR yarn alternating repeating pattern in the fill direction selected from the group consisting of 1:1, 2:1, 1:2, 2:2, 3:1, 2:3, 3:2, 3:3, 4:2, and 2:4;

wherein the intermingled FR yarns comprise a length and two plies, wherein the first ply comprises continuous multifilament fibers, and the second ply comprises staple FR fibers, wherein the first ply and the second ply have differential thermal shrinkage, wherein the intermingled FR yarns comprise distinct and discrete entanglement regions and non-entanglement regions along the length of the yarn, wherein in the entanglement regions the two plies are intermingled together where the staple fibers of the second ply are entangled in the continuous multifilaments of the first ply.

12. The flame resistant fabric of claim 11, wherein at least one ply of the intermingled FR yarn comprises continuous elastic multifilaments.

13. The flame resistant fabric of claim 11, wherein at least one ply of the intermingled FR yarn comprises a thermoplastic or thermoset material.

14. A garment comprising the fabric of claim 11.

15. The flame resistant fabric of claim 11, wherein the warp elements further comprise a plurality of intermingled FR yarns.

16. A flame resistant fabric comprising:

a plurality of warp elements comprising warp flame resistant (FR) yarns and intermingled FR yarns extending in a warp direction, wherein the warp FR yarns comprise a blend of nylon and FR-treated cotton fibers, and wherein the warp elements comprise between about 30 and 80% by number of yarns of intermingled FR yarns, and wherein the intermingled FR yarns and the warp FR yarns are arranged in an intermingled FR yarn:warp FR yarn alternating repeating pattern in the warp direction selected from the group consisting of 1:1, 2:1, 1:2, 2:2, 3:1, 2:3, 3:2, 3:3, 4:2, and 2:4;

a plurality of filling elements comprising filling FR yarns extending in the fill direction transverse to the warp direction in interwoven relation to the warp elements and wherein the filling FR yarns comprise FR-treated cellulosic fibers;

wherein the intermingled FR yarns comprise a length and two plies, wherein the first ply comprises continuous multifilament fibers, and the second ply comprises staple FR fibers, wherein the first ply and the second ply have differential thermal shrinkage, wherein the intermingled FR yarns comprise distinct and discrete entanglement regions and non-entanglement regions along the length of the yarn, wherein in the entanglement regions the two plies are intermingled together where the staple fibers of the second ply are entangled in the continuous multifilaments of the first ply.

17. The flame resistant fabric of claim 16, wherein at least one ply of the intermingled FR yarn comprises continuous elastic multifilaments.

18. The flame resistant fabric of claim 16, wherein at least one ply of the intermingled FR yarn comprises a thermoplastic or thermoset material.

19. The flame resistant fabric of claim 16, wherein the filling elements further comprise a plurality of intermingled FR yarns.

20. A garment comprising the fabric of claim 16.

* * * * *